US006067679A

United States Patent [19]

Rice

[11] Patent Number: 6,067,679

[45] Date of Patent: May 30, 2000

[54] HOSPITAL BED PROPPING PILLOW

[76] Inventor: John G. Rice, Seven Meadow Pl., Northport, N.Y. 11768

[21] Appl. No.: 09/289,924

[22] Filed: Apr. 12, 1999

[51] Int. Cl.[7] ..... A47C 20/00

[52] U.S. Cl. ..... 5/630; 5/633; 5/652; 5/490

[58] Field of Search ..... 5/630, 631, 632, 5/633, 640, 645, 652, 657, 485, 490, 491

[56] References Cited

U.S. PATENT DOCUMENTS

| | | | |
|---|---|---|---|
| 243,868 | 7/1881 | Doremus | 5/491 |
| 2,612,645 | 10/1952 | Boland | 5/633 X |
| 3,924,282 | 12/1975 | Bond | 5/632 |
| 3,992,733 | 11/1976 | Racine | 5/652 |
| 4,227,270 | 10/1980 | Rivera | 5/490 X |
| 4,574,412 | 3/1986 | Smith | 5/490 X |
| 4,744,117 | 5/1988 | Bond | 5/630 X |
| 5,802,644 | 9/1998 | Schuerer | 5/640 |

*Primary Examiner*—Michael F. Trettel
*Attorney, Agent, or Firm*—Myron Amer, P.C.

[57] ABSTRACT

A prop to hold a patient on his/her side while in a hospital bed in which a standard-sized hospital pillow is stowed in a rolled condition within a launderable sleeve having a sleeve-attached flap of approximately eight inches tucked beneath the patient's side which allows limited patient rolling movement against the prop which contributes to patient comfort. The eight inch dimension of the flap keeps the prop close to the patient so that more drastic movement which could cause injury does not occur.

1 Claim, 1 Drawing Sheet

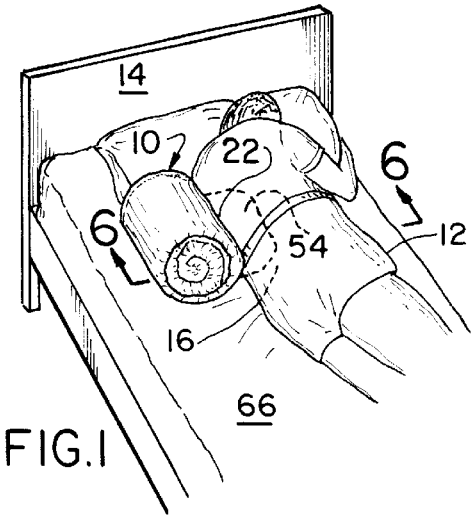
FIG.1
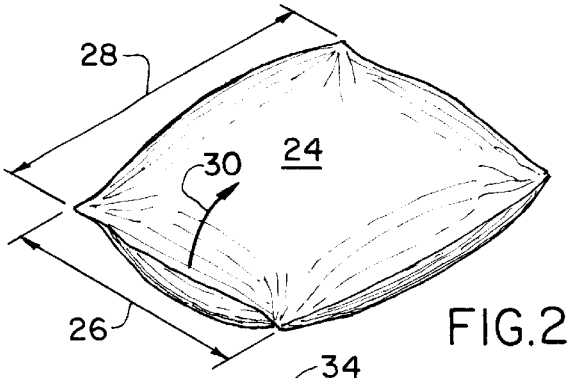
FIG.2
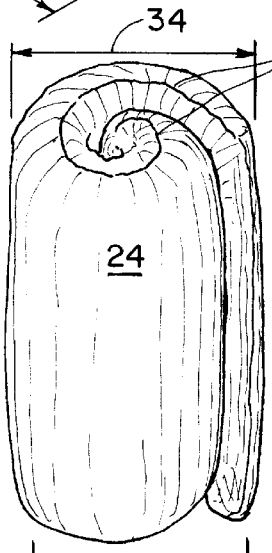
FIG.3
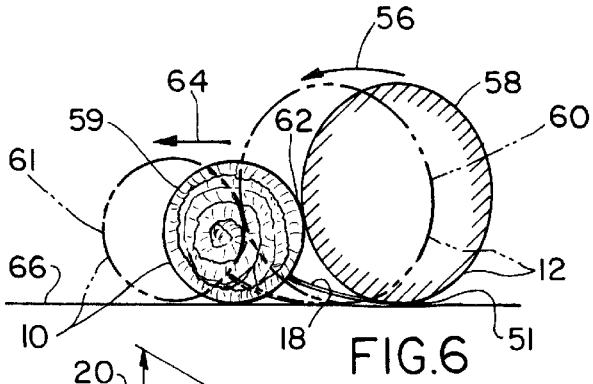
FIG.6
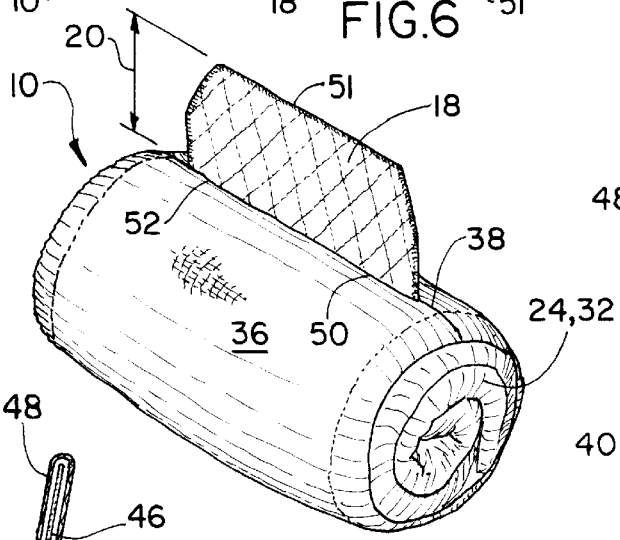
FIG.5
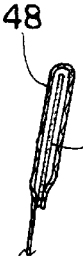
FIG.4
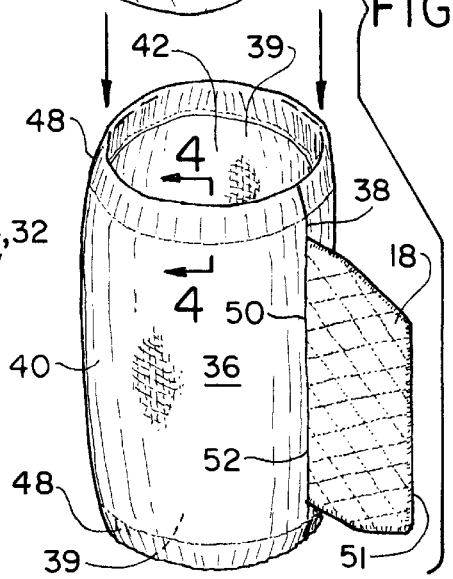

HOSPITAL BED PROPPING PILLOW

The present invention relates generally to a bed prop for a hospitalized patient, and more particularly to improvements in how the bed prop responds to passive and active interludes of the patient, to the end of significantly contributing to comfort and safety in the use of the bed prop.

Example of the Prior Art

Bed props for hospital use are well known, as exemplified by the bed prop described and illustrated in U.S. Pat. No. 3,924,282 issued to Helen Inez Bond for "Therapeutic Prop-Like Support For Hemiside Reclining Persons" on Dec. 9, 1975. These known bed crops are desirably constructed of launderable fabrics and are appropriately shaped, usually as a cylinder, to support a patient in a desired angular position on the patient's left or right side, to keep out of contact with the bed surface the patient's back and/or stomach, or the other propped-up side, in accordance with the handling of the patient dictated by the circumstances. In the use of these known bed props for the propping of hospital patients however, the patients are immobilized against movement, and thus in an active interlude the patient's effort, consciously or inadvertently, to resist being totally immobilized contributes to discomfort and in some cases even to injury. Total immobilizing of hospital patients is not necessary for proper care-giving and thus if dispensed with, would obviate unnecessary discomfort and injury.

Broadly, it is an object to provide an in-hospital used bed prop overcoming the foregoing and other shortcomings of the prior art.

More particularly, it is an object to provide a patient-responsive bed prop for a hospitalized patient that uses to advantage good nursing practice in hospitals, as will be subsequently better understood, to render the bed prop more comfortable and safer to use.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view illustrating use of the within inventive bed prop for a patient in a hospital bed;

FIG. 2 is an isolated perspective view of the hospital pillow component of the bed prop prior to being configurated into a rolled shape;

FIG. 3 is an illustration of the rolled shape provided the pillow component of FIG. 2 and its insertion within a cooperating sleeve component of the bed prop;

FIG. 4 is a partial sectional view as taken along line 4—4 of FIG. 3;

FIG. 5 is an isolated perspective view of the pillow and sleeve components in assembled relation; and FIG. 6 illustrates in full line and phantom line perspective the respective positions of movement of the bed prop and of the patient of FIG. 1 after an interval of activity, and as taken in section along lines 6—6 of FIG. 1.

Professional care givers and those familiar with hospital patient treatment understand that good nursing practice requires that the needs of bedridden hospital patients, and particularly those using a support or bed prop, to hold a healing wound out of contact with the bed surface or the like, be attended to at very specified time intervals, usually of 2–3 hours duration. It is also known by common experience that during a time interval, the patient can be passive (FIG. 1) or active (FIG. 6) , the latter being manifested by a rolling movement against the bed prop, generally designated 10 in drawings.

Underlying the present invention is the recognition that if the patient 12 is passive, the bed prop 10 will serve its end purposes intended, and that if the patient 12 is active, any difficulty caused by the activity will be corrected by the following of the nursing practice noted, and that until such correction the bed prop 10 should not immobilize the patient 12 since immobilization or inability to turn can cause injury to the patient 12, all as will be better understood as the description proceeds.

FIG. 1 illustrates the patient 12 in what will be understood to be a hospital bed 14 propped on a side 16 which is a well known position for various care-giving treatments, in which the bed prop 10 is wedged by an attached laterally extending L-lap 18, of an extending length 20 preferably not exceeding eight inches, against the patient's back 22 such that if the patient 12 is passive, flat 18 holds the bed prop 10 in place, as illustrated in FIG. 1.

Bed prop 10 includes a pillow 24 standardized in size for hospital use and which is rectangular in shape and measures 18 inches in width 26 and 23 inches in length 28 and which when rolled in the direction of the arrows 30 in FIG. 2 assumes helical turns 32 that typically has a diameter 34 of 7½inches.

Cooperating with the rolled pillow 24, 32 of FIG. 3 is a cylindrical sleeve 36 sewn along seam 38 and having open ends 39 and which has a wall circumference 40 of preferably 23 inches bounding a pillow compartment 42 adapted by its size to receive in projected or stowed relation therein the rolled pillow 24, 32 through one of the end openings 39. Sleeve 36 has elastic strips 46 hemmed in the edges 48 bounding the end openings 39 to contribute to holding the stowed rolled pillow 32 within the compartment 42. As thusly constructed and using as a construction material a fabric that is launderable, simple removal of the rolled pillow 32 prepares the sleeve 36 for sanitizing as required.

Completing the construction of the sleeve 36, and to be noted as an essential component thereof, is the previously noted flap 18 also of launderable fabric construction material having an edge 50 best caught in the seam 38, as at 52, so as to extend laterally of the sleeve 36, as noted at 54, a selected distance under the weight of the patient 12 as best illustrated in FIG. 1 and typically being eight inches.

As best shown in FIG. 6, if the patient 12 is active, this activity will be manifested as an effort to roll in the direction 56 from the propped position, depicted in full line at 58, into the changed position, depicted in phantom line at 60, these position changes 58 and 60 being against the bed prop 10 and a function of the weight of the patient and the extent of effort, knowingly or inadvertently, exerted by the patient 12. If these position changes 58 and 60 are totally resisted by correspondingly total immobilization of the patient 12 by the bed prop 10, the pressure buildup at the patient-to-bed prop contact with each other as at 62, could, and has been known, to cause injury to the patient 12 and at the least to cause significant discomfort to the patient 12.

Using to advantage the nursing routine or practice of attending to the patient 12 at least once every 2–3 hours, at which any movement change will be corrected as required, the flap 18 effectively contributes to lineal tracking 64, and obviates rolling movement of the bed prop 10 during its position changes from full line 59 to phantom line 61 depictions in FIG. 6.

In practice, it has been found that the laterally extending four inch surface of the flap 18 is of sufficient size to maintain enough of the flap front edge 51 in an interposed position between the patient 12 and bed surface 66 to prevent complete separation of the patient 12 and bed prop 10 at contact location 62 and yet the bed prop 10 will partake of the linear movement 64 to prevent injury and discomfort of the patient.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A hospital bed prop comprising an open-ended cylindrical sleeve of launderable fabric construction material having a body bounding a pillow-receiving shapeable compartment of a circumference of approximately 23 inches and opposite end edges bounding opposite end openings into and out of said pillow-receiving shapeable compartment, a rectangular pillow sized in an approximate width of 18 inches and in an approximate length of 23 inches having an operative condition rolled into helical turns from a first widthwise-oriented rectangular side to an opposite second widthwise-oriented rectangular side so as to have a diameter slightly greater than said diameter of said pillow-receiving shapeable compartment, an operative position of said pillow in said rolled operative condition stowed within said pillow-receiving shapeable compartment so as to impart to said compartment and to said sleeve body a cylindrical shape against which a patient's back is adapted to be supported, a flap of launderable fabric construction material having a rear edge attached to said sleeve and an unattached front edge bounding therebetween a flap body of a selected extent, and said selected extent of said flap body being no greater than approximately 8 inches so as to have applied thereon a minimal weight of a patient's said back and a side, whereby in response to rolling movement of said patient against said sleeve said flap obviates a corresponding rolling degree of movement in said sleeve while permitting a lateral degree of movement thereof.

* * * * *